United States Patent [19]

Kadish

[11] Patent Number: 4,799,276

[45] Date of Patent: Jan. 24, 1989

[54] BODY REST WITH MEANS FOR PREVENTING PRESSURE SORES

[76] Inventor: Ehud Kadish, 49945 Moshav Neve Yarak, Israel

[21] Appl. No.: 95,225

[22] Filed: Sep. 11, 1987

[30] Foreign Application Priority Data

Sep. 15, 1986 [IL] Israel ..... 80025

[51] Int. Cl.[4] ..... A47C 27/08

[52] U.S. Cl. ..... 5/446; 5/447; 5/453; 137/901

[58] Field of Search ..... 5/446, 447, 453, 455, 5/456, 258; 137/901

[56] References Cited

U.S. PATENT DOCUMENTS

| | | | |
|---|---|---|---|
| 1,173,620 | 2/1916 | Thompson | 137/901 X |
| 3,784,994 | 1/1974 | Kery | 5/456 |
| 3,822,425 | 7/1974 | Scales | 5/456 |
| 3,879,776 | 4/1973 | Solen | 5/453 |
| 3,919,730 | 11/1975 | Regan | 5/456 |
| 4,190,286 | 2/1980 | Bentley | 5/455 X |
| 4,347,633 | 9/1982 | Gammons et al. | 5/456 X |
| 4,542,547 | 9/1985 | Sato | 5/477 X |
| 4,617,690 | 10/1986 | Grebe | 5/453 |
| 4,644,593 | 2/1987 | O'Brien | 5/447 X |

FOREIGN PATENT DOCUMENTS

| | | | |
|---|---|---|---|
| 2922619 | 12/1980 | Fed. Rep. of Germany | 5/465 |
| 2107197 | 4/1983 | United Kingdom | 5/453 |

*Primary Examiner*—Ramon S. Britts
*Assistant Examiner*—David L. Talbott
*Attorney, Agent, or Firm*—Leonard Bloom

[57] ABSTRACT

A body rest such as a bed with means incorporated for avoiding the development of pressure sores (decubitus ulcer) caused by prolonged local pressure against a patient's body. The bed comprises: a matrix of freely vertical displaceable supports, in the form of free-floating, pressurized air-supported pistons, constituting together the continuous couch surface of the bed. The pressure exerted by the patient's body sections against their respective support pistons is constantly measured. Valves are provided associated with and controlling the discharge of the air from the piston chambers under the pressure applied to each one of the respective support pistons. After a preset time and level of pressure prevailing within a given piston chamber, a fixed amount of air is discharged, thereby partly relieving the pressure and causing the downward displacement of the respective piston. At the end of the cycle, all the pistons are brought back to their initial, common high level.

20 Claims, 6 Drawing Sheets

BODY REST WITH MEANS FOR PREVENTING PRESSURE SORES

BACKGROUND OF THE INVENTION

The physiology of the human body is such that, when the body rests on a support, say a mattress of a bed or a chair seat, there will always be certain body portions subject to excessive pressure relative to other body portions. Should such peak local pressure be maintained for a prolonged period, and not be relieved by changing the posture of lying or sitting, damage will be caused to the tissue, referred to in medical literature as pressure sores, or decubitus ulcers. The development of pressure sores is aggravated by excessive temperature and perspiration.

Various solutions have been proposed in cases here the patient is unable to help himself by changing his lying position (paralyzed or geriatric cases), such as vibrating or massaging means attached to the bed. None of the prior art solutions has in fact been widely used, being rejected as either too costly and/or ineffective.

It is therefore the general object of the present invention to provide means associated with body rests that will effectively overcome the disadvantages of the known solutions.

It is a further object of the invention to provide body rests divided into a plurality of individual, local body rest members which are adapted to be displaced to relieve any excessive local pressure to which they were subjected for a prolonged time.

It is a still further object of the invention to provide a control system responsive to pressure vs. time parameters for displacing—i.e. lowering—any one of the displaceable members.

It is a still further object of the invention that such displacement be effected in a stepwise manner, by having each support member suspendingly held by fluid pressure, e.g by an air or other gas cushion, and, once in a while, as sensed by the control system, relieving a defined, fixed volume of the gas from the respective cushion.

SUMMARY OF THE INVENTION

Thus is provided according to the invention a body rest such as a bed or a chair seat, with means incorporated for avoiding the development of pressure sores caused by prolonged local pressure against a patient's body, comprising a matrix of freely displaceable vertical support members, having head portions each constituting a fraction of a continuous couch surface of the body rest, pressure responsive means associated with each head portion adapted to measure the pressure of the respective patient's body sections against its support member, fluid chamber means provided underneath and floatingly supporting each of the support members, valve means associated with and controlling the discharge of fluid from the chambers under the pressure of the respective support member, valve actuator means for selectively opening any of the valve means, fluid batching means for receiving a predetermined, fixed amount of fluid discharged from the fluid chamber upon actuation of the valve means by the valve actuator means thereby partly relieving the pressure within the fluid chamber and causing the downward displacement of the respective support member, means for venting the batching means after release of the valve by its actuating means and control means operatively associated with the pressure responsive means for actuating the valve means when the said prolonged local pressure exceeds a predetermined amount.

BRIEF DESCRIPTION OF THE DRAWINGS

For better understanding the conceptual approach and constructional features of the invention, reference will be made to a preferred embodiment thereof, given by way of example only, with reference to the accompanying drawings, wherein.

DESCRIPTION OF THE PREFERRED EMBODIMENT

Figure 1:
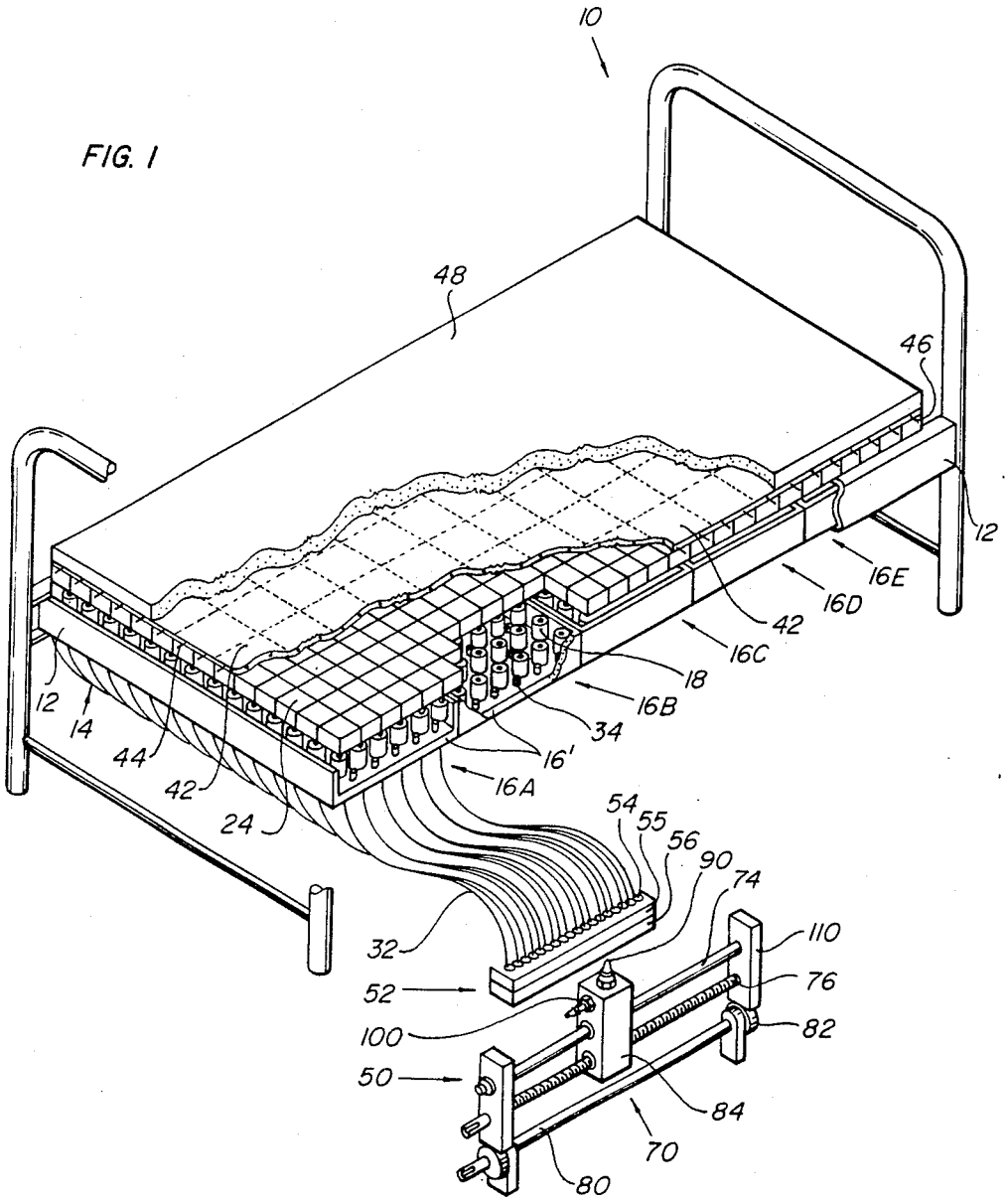
FIG. 1 is a general, schematic view of a bed provided with the substrate constituted by displaceable support members, the pressure detecting means, and the pressure relieving system according to the invention.

In FIG. 1 there is shown a body rest such as a hospital or geriatric institute bed generally designated 10 provided with means embodying the characteristic features of the present invention. Hence, bed frame 12 supports a bed substrate 14 which, for a purpose to be explained in detail below, is divided into a number, e.g. five, identical sub-assemblies designated 16A, 16B, 16C, 16D and 16E.

Figure 2:
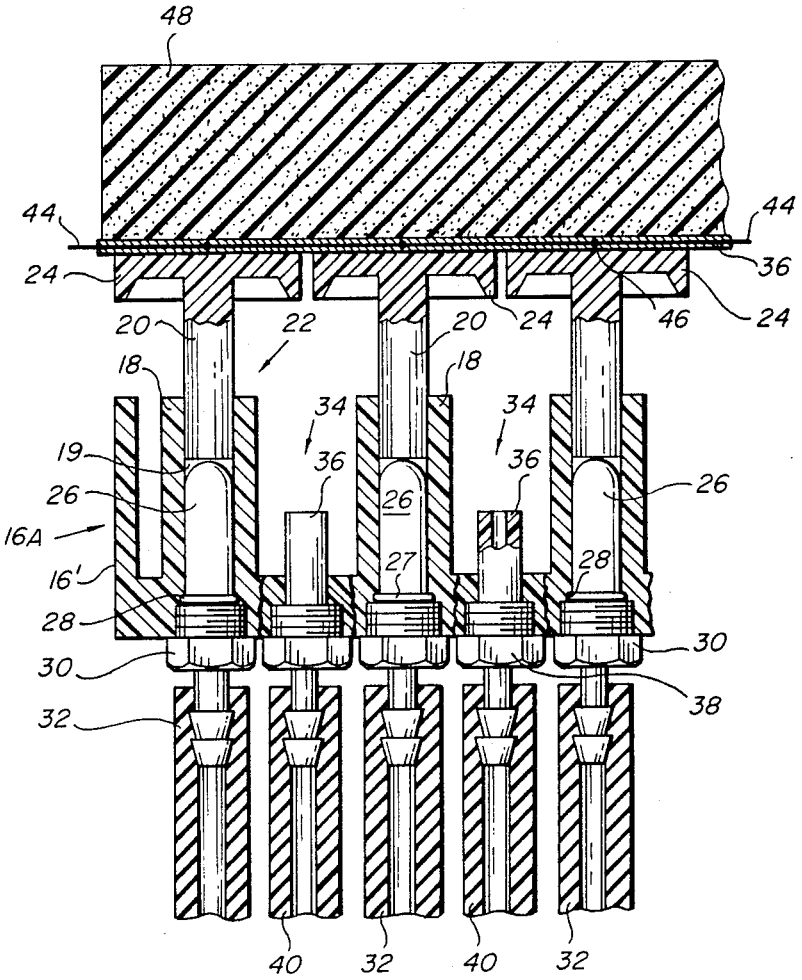
FIG. 2 is a cross-sectional view of the body rest section with the fluid pressure supported members.

As shown in more detail in FIG. 2, each sub-assembly comprises a baseboard 16' provided with a plurality of upward extending, cylinder-like sleeves 18 defining spaces 19 within which there are freely sliding piston-like stems 20 of mushroom-like displaceable members 22 having a squarish head 24.

Within space 19 of the cylinder 18 below the stem 20, there is placed an inflatable sleeve 26 having its open rim 27 directed downward and sealed against a cavity 28 by a pipe fitting 30. A flexible rubber pipe 32 is connected to the fitting 30 for the inflation or deflation of the sleeve 26.

It will be noted that the use of the inflatable sleeve is optional and was selected only to obviate the problem of sealing between the cylinder 18 and the piston 20. The sleeve 26 thus serves as an air chamber or cushion by which the members 22 are rested.

Further installed in the baseboards 16' are a series of ventilation injectors designated 34, comprising jet nozzles 36, pipe fittings 38 and supply pipes 40. On the body rest couch surface composed of all the heads 24 of the members 22, there is spread a blanket 42 which, as schematically shown, is provided with a plurality of electrical terminals 44 and 46. The blanket 42 is composed of a respective number of capacitor elements known per se in the art as means for the detection and measurement of pressure exerted on their surfaces. Hence, for each support member 22 and respective head portion 24, there is associated a pressure responsive capacitor whose pressure reading is constantly measured through its respective terminals 44 and 46 (see reference to FIG. 6 below).

Above the blanket 22 there is spread a conventional foam rubber mattress 48.

Figure 3:
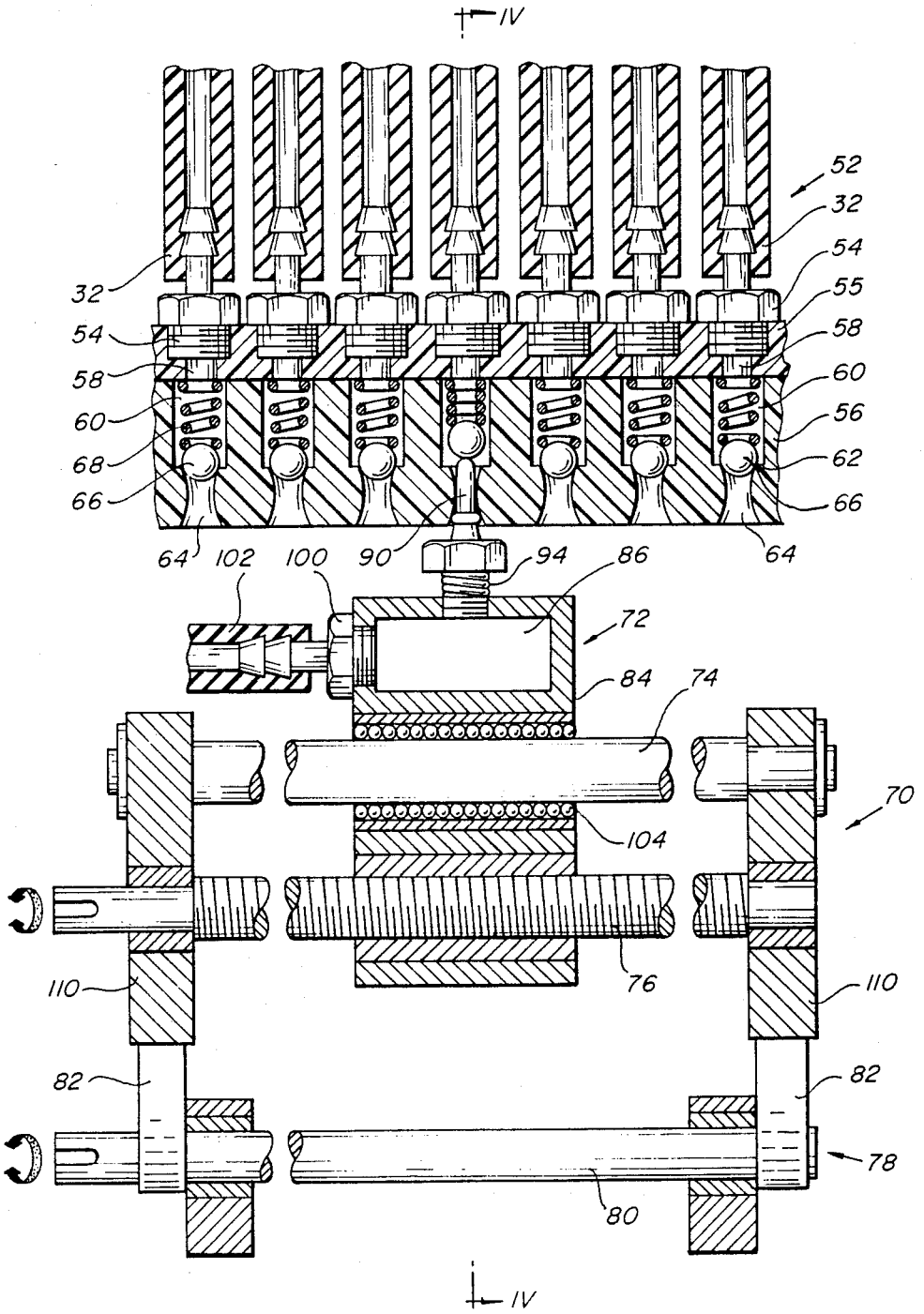
FIG. 3 shows an embodiment of the selective pressure relieving system.
Figure 5:
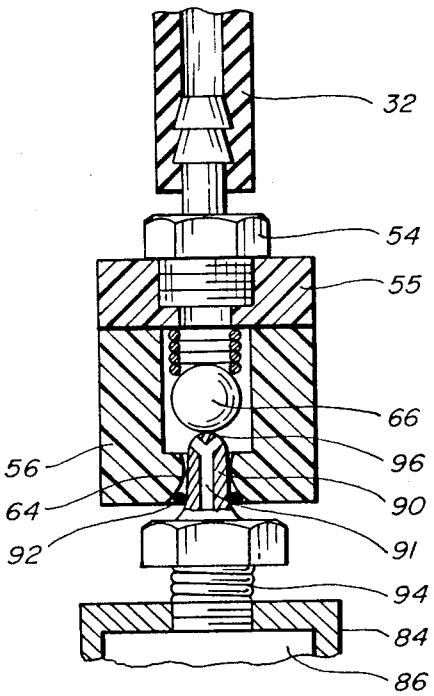
FIG. 5 is a section taken along line V—V of FIG. 5, on an enlarged scale.
Figure 4:
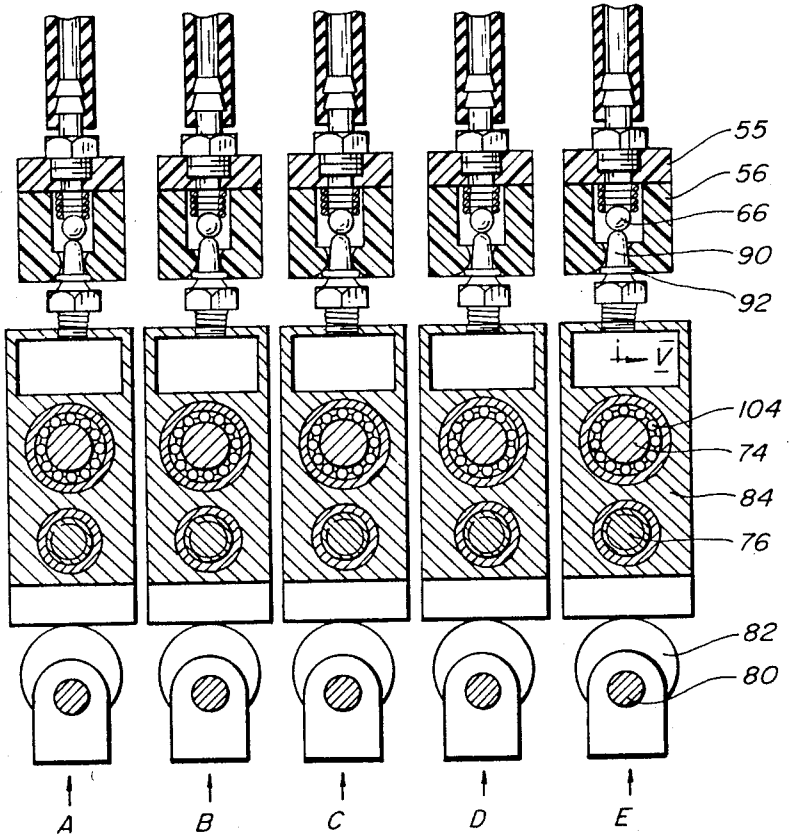
FIG. 4 is a section taken along lines IV—IV of FIG. 3.

Associated with each sub-assembly 16 is a selective pressure reduction system generally indicated 50 in FIG. 1, details of which are more clearly shown in FIGS. 3–5. System 50 comprises a breadboard or assembly rack 52 which is elongated and to which all the pipes 32 are connected side-by-side, as by fittings 54 on a common bar 55.

It is thus accomplished that all the support members 22 are connected to the bar 55 along a continuous, straight line (rather than the matrix fashion by which they are installed at the bed body rest proper).

A counterpart bar 56 is attached to the bar 55 (in an airtight manner) with passages 58 thereof in register with cavities 60, valve seats 62 and convergent or nozzle-like openings 64 merging from the bottom of the board 56. Within the cavities 60 globes or balls 66 are placed, urged by springs 68, serving as check valves in the direction of the openings 64.

The system 50 further comprises a carriage assembly generally denoted 70 which includes a gliding member 72, guide rod 74, feeding screw-threaded spindle 76 and a lifting assembly 78 comprising a rotatable axle 80 with cams or eccenters 82 provided at each side of the assembly.

In more detail, the carriage assembly 72 is in the form of a block 84 defining a hollow, "batching" space 86 at its upper portion.

A valve actuator member is provided at the top of the block 84. It is in the form of a push rod or finger 90 with a throughgoing passage 91 (FIG. 5) insertable with proper gasket or sealing ring 92 into the opening 64 of the bar 56, and is resiliently mounted by coil spring 94 on top of the block 84.

In its inserted position as shown, nib 96 of the finger or rod 90 lifts the ball 66 of the respective valve, allowing free communication to the space 86 through the passage 91.

Figure 7:
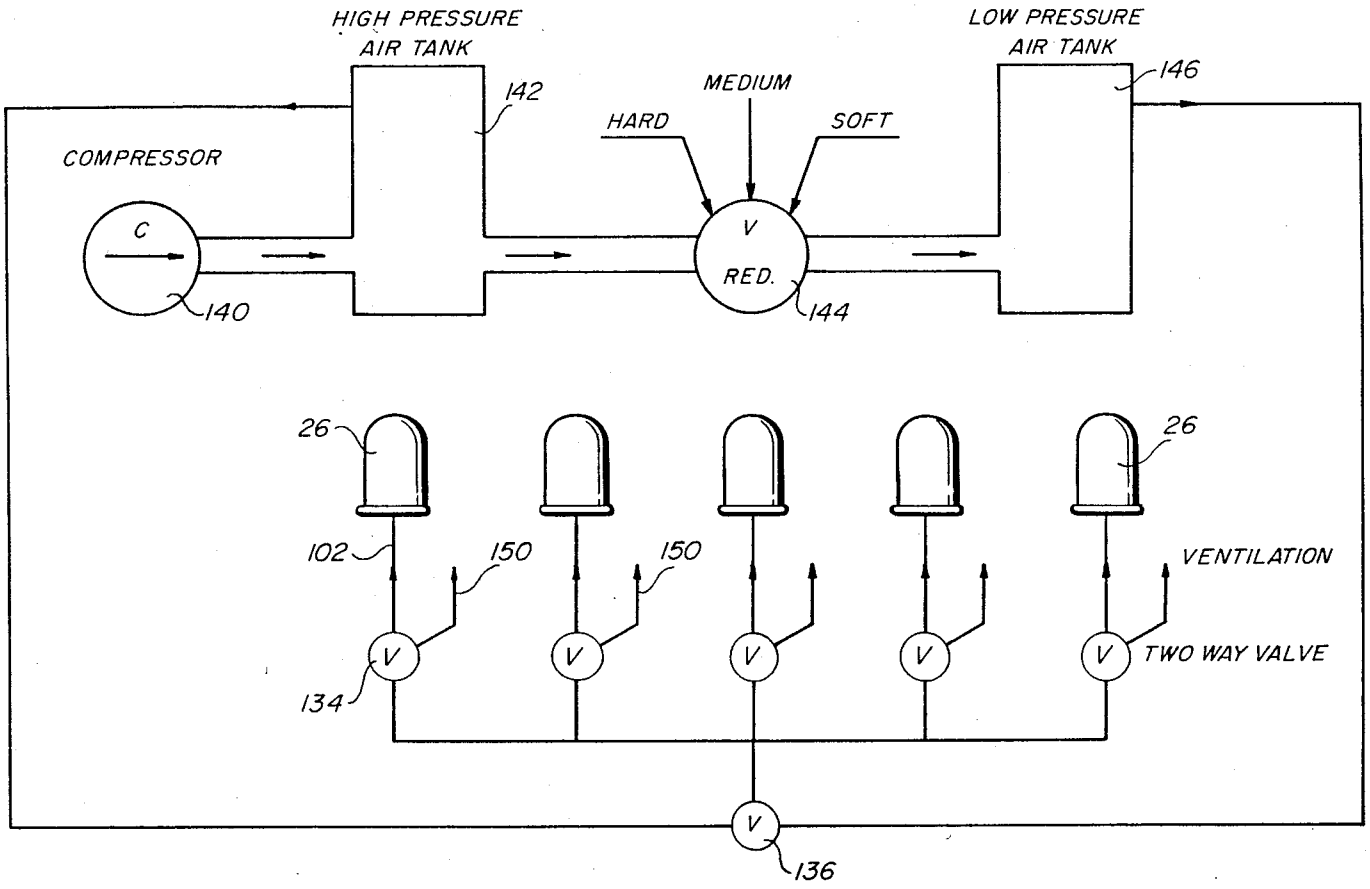
FIG. 7 is a schematic diagram of the gas supply and venting system.

The space 86 is further connected via fitting 100 and pipe 102 by a gas charging system to be described below with reference to FIG. 7.

As above stated, the carriage 72 is movable along a linear path defined by the guide rod 74, preferably by ball bearing 104. Driving of the carriage 72 in one or the other direction is achieved through rotation of the spindle 76 by suitable motor means (not shown).

The assembly comprised of the carriage 72 and associated driving means is reciprocating in a vertical plane by the eccenters 82 acting against the mountings 110.

Oscillation of the axle 80 for lifting and lowering the carriage assembly 70 is effected by motor means coupled to the axle 80 (not shown).

As above stated, such valve assembly breadboards 52 and carriage assemblies 70 are provided for each one of the five bed sections 16 (see FIG. 4), bearing however in mind that this division is made for convenience of construction only; there may therefore be provided less or more subassemblies or, alternatively, a more complicated carriage system, controllably movable in crossing directions, may be designed to fulfill the requisites of the system as will be explained below. The body rest assembly as so far described is operated and controlled by the system schematically shown in FIG. 6. The relevant, current data of the specific pressures (or forces) prevailing on each one of the capacitor pressure responsive elements 42 is relayed by their respective terminals 44–46, via a scanning system 120 to a database 122 of a microprocessor 124.

The microprocessor 124 is further comprised with means receptive of data relating to a lapse of time and pressure calibration. The microprocessor processes the information in a manner to detect those pressure feelers with respect to which the integrated sum of pressure and time exceeds a certain preset value, specifically values that will be found above curve 125 of the Pressure vs. Time diagram shown in FIG. 6. Should it be determined by the system that the combined pressure and time with respect to a detected support member is beyond the permissible range, it will regard it as a potential source of a pressure sore—if left unattended—and will set into operation control system 126 in the manner to be described below.

Figure 6:
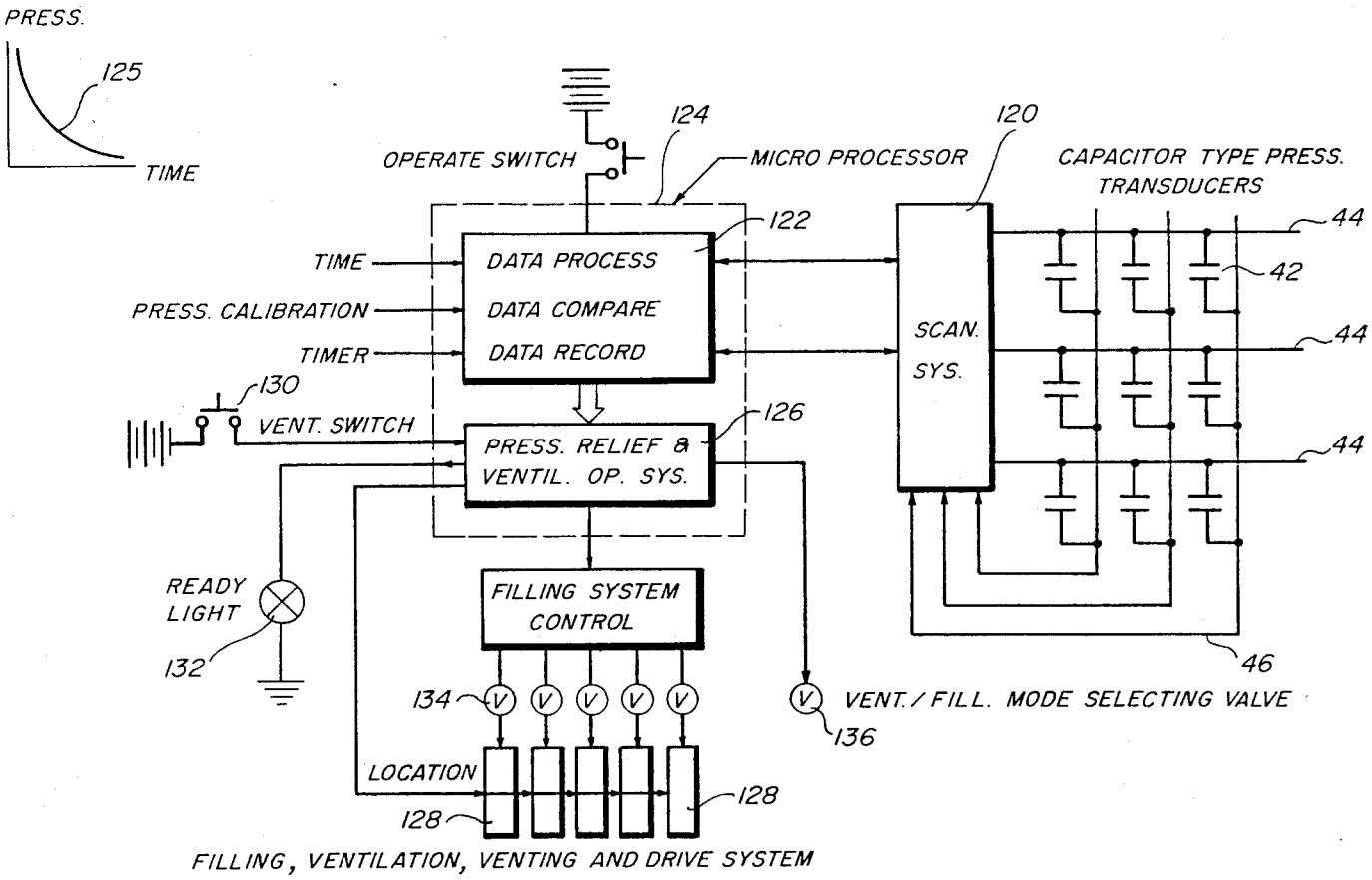
FIG. 6 is a schematic diagram of the control system.

As further shown in FIG. 6, the control system 126 is coupled to five pressure relief units marked 128, which correspond to the five carriage units 70 of FIGS. 3–5. Further included in the system of FIG. 6 is a ventilating or blowing switch 130, a pilot lamp 132, a series of valves 134, and a ventilation/filling mode selector valve 136, the functions of which will be described in connection with the pneumatic system of FIG. 7.

As aforementioned, perspiration and heat are additional factors that should be taken into account in the prevention of pressure sores. It is therefore proposed, according to another aspect of the present invention, to provide ventilating or gas blowing means for locally and/or generally treating the bed rest, i.e., mattress 48, using the above referred-to nozzles 34 (FIG. 2). Hence, the system of FIG. 7 comprises a compressor 140 or other source of pressurized gas (such as liquefied $CO_2$, which is also suitable for the purposes in question) which charges high pressure vessel 142.

Further provided is a three-position pressure reduction valve 144 for controlling the working pressure of the system. A low pressure vessel 146, which supplies the pressurized air to the system, is connected via the above mentioned mode selection valve 136 in parallel to the five valves 134 referred-to in connection with FIG. 6. Conduits 102 connect the valves 134 to the sleeves 26. Valves 134 may be also set in a venting position as schematically shown by the extensions 150 which represent the above-mentioned mattress ventilating means, i.e. the nozzles 34.

The system operates as follows: Initially, it should be ascertained that all the support member heads 24 are positioned at the same, highest level. This is achieved by simultaneously filling all the inflatable sleeves 26 through their conduits 32 with valves 134 and 136 in their proper position. The lamp 132 will become lit to signal that the system is ready for operation. The control system of FIG. 6 is set to monitor, via the capacitors 42 and the scanning system 120, the pressure conditions prevailing with respect to each and every one of the support members 22.

Valves 134 and 136 are closed, as well as all the valves 66 of the air sleeves relieving system. Carriages 70 are in a non-operative position, i.e. lifting rod 90 is withdrawn.

Upon location of a certain support member 22 with respect to which displacement must be performed, the control system 126 sets into operation the respective one of the units 128, which controls the linear movement of the carriage 72 along the series of valves 66 installed in the bar 56. When properly located underneath the respective valve 66, eccenters 82 are operated to lift the carriage and push bar 90 upwards (see FIG. 5). The air chamber of balloon 26 will become connected through passage 91 to the batching space 86. The pressure within the batching space 86 will equalize with the pressure of the air chamber 26, reducing it in proportion to the volume of the space 86. Due to such reduced pressure, the respective support member 22 will descend by a certain amount. When the push rod 90 is withdrawn, the space 86 will be connected to the atmosphere and the extra pressure accumulated therein will be vented. The downward displacement of the support member 22 will, of course, change the pressure distribution on the mattress and relieve the peak pressure that was located before the batching cycle.

Similar batching cycles will be performed, one at a time, with respect to any support member whose pressure and time conditions call for interference according to the criteria upon which the system is programmed to react. Once in every preset while—or at will, by means of the ventilation switch 130—a ventilating cycle will be performed in the following manner. The valves 136 and 134 will be set to connect the ventilating valves 134 to the high pressure source 142. Pressurized air will reach the ventilation nozzles 34 through the conduits 40, which are all in communication with the discharge conduits marked 150 in FIG. 7. Air under pressure will thus be blown against the bottom of the mattress 48 which, being preferably of foam rubber, will become aerated, dried, and cooled at the same time, to further reduce the likelihood of the development of pressure sores.

After several downward displacements of one or more of the support members 22, it may come to the end of its range, namely when the pressure within air sleeves 26 equals or is somewhat above the atmospheric pressure. At this stage, a resetting of all the support members is required, which is accomplished in the manner first described above in connection with the initial preparation of the body rest operation, which involves inflating, to the same high pressure, all of the air sleeves or balloons 26.

From the foregoing description, it will be now evident that the use of air-filled balloons as well as the stepwise reduction of pressure (quantity) is advantageous in the respect that there is no need for complicated and costly sealing means nor dynamic pressure reducing devices. While the above-described embodiment specifically refers to air or other gases (CO2), the use of liquids should not be ruled out, and may even be found advantageous under certain circumstances and for other considerations.

It will also now readily be understood that the division of the body rest into a plurality of groups to be served by a linear movable carriage system was also suggested with a view to reducing to a minimum the manufacturing costs by making the system as simple as possible.

The incorporation of the ventilating facilities is in fact a by-product of the provision of the pressurized air supply, that must be available in connection with the filling of the air chambers or balloons. The addition of such a ventilating system is of high operational value, and at an insignificant addition to the overall cost of the system.

It has thus been established that the system according to the invention provides an effective and relatively simple solution to the problem of pressure sores. Those skilled in the art to which the invention pertains will understand that various changes, variations and modifications may be applied with respect to the above described preferred embodiment thereof without departing from the scope of the invention as defined in and by the appended claims.

What is claimed is:

1. A body rest such as a bed or a chair seat with means incorporated for avoiding the development of pressure sores caused by prolonged local pressure against a patient's body, comprising:

a matrix of freely vertical displaceable support members, having head portions each constituting a fraction of a continuous couch surface of the body rest;

pressure responsive means associated with each head portion adapted to measure the pressure of the respective patient's body sections against its support member;

fluid chamber means provided underneath and floatingly supporting each of the support members;

valve means associated with and controlling the discharge of fluid from the chambers under the pressure of the respective support member;

valve actuator means for selectively opening any of the valve means;

fluid batching means for receiving a pre-determined, fixed amount of fluid discharged from the fluid chamber upon actuation of the valve means by the valve actuator means thereby partly relieving the pressure within the fluid chamber and causing the downward displacement of the respective support member;

means for venting the batching means after release of the valve by its actuating means; and control means operatively associated with the pressure responsive means for actuating the valve means when the said prolonged local pressure exceeds a pre-determined amount.

2. The body rest as claimed in claim 1 wherein the support members are generally mushroom-shaped having a square head and a downward extending cylindrical stem, slidingly received in a bore, the space underside the stem constituting the fluid chamber means.

3. The body rest as claimed in claim 2 wherein the fluid chamber means further comprise fluid-filled inflatable sleeves against which the stems directly rest.

4. The body rest as claimed in claim 3 wherein the valve means is a globe-valve comprising a globe spring urged against a valve seat.

5. The body rest as claimed in claim 4 wherein the valve actuating means comprise, associated with each of the fluid chambers, a valve release member adapted to engage and displace the valve globe from its valve seat.

6. The body rest as claimed in claim 5, wherein the valve release member includes an elongated push rod adapted to pass through the valve seat.

7. The body rest as claimed in claim 1, wherein the valve means is a globe-valve compressing a globe spring urged against a valve seat;

wherein the valve actuating means includes, associated with each of the fluid chambers, a guide bore having a portion thereof being of a reduced cross-section, a valve release member adapted to engage and displace the valve globe from its valve seat;

wherein the valve release member includes an elongated push rod adapted to pass through the valve seat;

wherein the push rod is slideable within and sealed against the portion of reduced cross-section of the guide bore, the rod being provided with a passage for the flow of the fluid in the valve engaging position.

8. The body rest as claimed in claim 7 wherein the batching means comprises an enclosed space in communication with the passage.

9. The body rest as claimed in claim 8 wherein the enclosed space is vented to the atmosphere to release the fluid in the valve disengaging position.

10. The body rest as claimed in claim 1 wherein the pressure responsive means comprise transducer means for converting the pressure readings into electrical readings.

11. The body rest as claimed in claim 10 wherein the transducer means comprise capacity-to-pressure transducing means.

12. The body rest as claimed in claim 11 further comprising a scanning system for continuously measuring the reading of the transducing means, a computerized system for processing the integrated sum of the pressure readings as a function of time adapted to operate the driving and valve actuating system.

13. The body rest as claimed in claim 12 wherein there is further provided a series of ventillating gas jet nozzles underside the body rest and a pressurized gas source connected to the nozzles.

14. The body rest as claimed in claim 13 wherein the valve means and the jet nozzles are provided on a common support bar.

15. A body rest such as a bed or a chair seat with means incorporated for avoiding the development of pressure sores caused by prolonged local pressure against a patient's body, comprising;

a matrix of freely vertical displaceable support members, having head portions each constituting a fraction of a continuous couch surface of the body rest; pressure responsive means associated with each head portion adapted to measure the pressure of the respective patient's body sections against its support member;

fluid chamber means provided underneath and floatingly supporting each of the support members;

valve means associated with and controlling the discharge of fluid from the chambers under the pressure of the respective support means;

valve actuator means for selectively opening any of the valve means;

fluid batching means for receiving a pre-determined, fixed amount of fluid discharge from the fluid chamber upon actuation of the valve means by the valve actuator means thereby partly relieving the pressure within the fluid chamber and causing the downward displacement of the respective support member;

means for venting the batching means after release of the valve by its actuating means; and control means operatively associated with the pressure responsive means for actuating the valve means when the said prolonged local pressure exceeds a pre-determined amount;

wherein the support members are generally mushroom-shaped having a square head and a downward extending cylindrical stem, slidingly received in a bore, the space underside the stem constituting the fluid chamber means;

wherein the fluid chamber means further comprise fluid-filled inflatable sleeves against which the stems directly rest;

wherein the valve means is a globe-valve comprising a globe spring urged against a valve seat;

wherein the valve actuating means comprise, associated with each of the fluid chambers, a valve release member adapted to engage and displace the valve globe from its valve seat;

wherein the valve release member includes an elongated push rod adapted to pass through the valve seat;

wherein the push rod is slideable within and sealed against and sealed against a guide bore, the rod being provided with a passage for the flow of the fluid in the valve engaging position;

wherein the batching means comprises an enclosed space in communication with the passage;

wherein the enclosed space is vented to the atmosphere to release the fluid in the valve disengaging position; and wherein the space is comprised in a moveable member, the push rod being rigidly mounted to and projecting from a top surface of the member.

16. The body rest as claimed in claim 15 wherein the movable member is coupled to a driving system for bringing the push rod into the valve engaging position.

17. The body rest as claimed in claim 14 wherein for every given series of support and respective valve members there is provided one movable member, the driving system being controlled to selectively bring the push rod into the engaging position with each valve of the series.

18. The body rest as claimed in claim 17 wherein the driving system comprises a rotatable screw-threaded spindle, a cam-operated displacing device and guide means, all being operatively coupled to the movable member for feeding the movable member into a predetermined location and displacing same to actuate the valve means of a selected support member.

19. A body rest, such as a bed or a chair seat, including a continuous couch having a surface and an underside and further including means for avoiding the development of pressure sores caused by prolonged local pressure against a patient's body, in combination, comprising;

a matrix of freely vertical displaceable support members, each of said support members having respective head portions, each head portion constituting a fraction of a continuous couch surface of the body rest;

pressure responsive means associated with each head portion adapted to measure the pressure of the respective patient's body sections against its support members;

fluid chamber means provided underneath and floatingly supporting each of the support members;

means for filling the respective fluid chambers with a fluid, whereby a fluid pressure is created therein for supporting the support members;

a respective valve means associated with each respective chamber for controlling the discharge of fluid from the respective chambers under the pressure of the respective support member;

valve actuator means for selectively opening any of the valve means, such that fluid in the chamber associated therewith may be discharged therefrom through the valve means;

fluid batching means including a batching space having a pressure therein being less than the pressure of the pressure in the fluid chambers for receiving a pre-determined, fixed amount of fluid discharged from the fluid chamber upon activation of the valve means by the valve actuator means, such that the pressure within the fluid chamber is bought into equilibrium with the pressure in the batching chamber, thereby partially relieving the pressure within the fluid chamber and causing the downward displacement of the respective support member;

means for venting the batching space after release of the valve by its actuating means, whereby a pressure in the batching space is established;

control means operatively associated with the pressure responsive means for actuating the valve means when the said prolonged local pressure exceeds a pre-determined amount; and wherein the fluid chambers may be selectively displaced downwardly in a stepwise fashion in response to the pressure controlled means.

20. A body rest, such as a bed or a chair seat, including a continuous couch having a surface and an underside and further including means for avoiding the development of pressure sores caused by prolonged local pressure against a patient's body, in combination, comprising;

a matrix of freely vertical displaceable support members, each of said support members having respective head portions, each head portion constituting a fraction of a continuous couch surface of the bodyrest;

pressure responsive means associated with each head portion adapted to measure the pressure of the respective patient's body sections against its support member;

fluid chamber means provided underneath and floatingly supporting each of the support members;

means for filling the respective fluid chambers with a fluid, whereby a fluid pressure is created therein for supporting the support members;

a respective valve means associated with each respective chamber for controlling the discharge of fluid from the respective chambers under the pressure of the respective support member;

valve actuator means for selectively opening any of the valve means, such that fluid in the chamber associated therewith may be discharged therefrom through the valve means;

fluid batching means including a batching space having a pressure therein being less than the pressure of the pressure in the fluid chambers for receiving a pre-determined, fixed amount of fluid discharged from the fluid chamber upon activation of the valve means by the valve actuator means, such that the pressure within the fluid chamber is bought into equilibrium with the pressure in the batching chamber, thereby partially relieving the pressure within the fluid chamber and causing the downward displacement of the respective support member;

means for venting the batching space after release of the valve by its actuating means, whereby a pressure in the batching space is established;

control means operatively associated with the pressure responsive means for actuating the valve means when the said prolonged local pressure exceeds a pre-determined amount;

wherein the fluid chambers may be selectively displaced downwardly in a stepwise fashion in response to the pressure controlled means; and a plurality of ventilating gas jets, each jet having an outlet nozzle positioned beneath the couch and being oriented at the underside of the couch and spaced therefrom, each of said outlet nozzles terminating below the support members, such that at all times the outlet nozzle is spaced from the underside of the couch, each jet further having an inlet being selectively connected to a pressurized gas source, such that pressurized gas may be selectively directed towards the couch.

* * * * *